US010263371B2

(12) United States Patent
Dejardin et al.

(10) Patent No.: US 10,263,371 B2
(45) Date of Patent: Apr. 16, 2019

(54) COAXIAL CONNECTOR INTEGRATED WITH A SHIELDING AND ELECTRONIC CARD EQUIPPED WITH SUCH A CONNECTOR

(71) Applicant: SAGEMCOM BROADBAND SAS, Rueil Malmaison (FR)

(72) Inventors: Romain Dejardin, Rueil Malmaison (FR); Herve Lieven, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 0 days.

(21) Appl. No.: 15/529,270

(22) PCT Filed: Dec. 1, 2015

(86) PCT No.: PCT/EP2015/078247
§ 371 (c)(1),
(2) Date: May 24, 2017

(87) PCT Pub. No.: WO2016/087462
PCT Pub. Date: Jun. 9, 2016

(65) Prior Publication Data

US 2017/0264056 A1 Sep. 14, 2017

(30) Foreign Application Priority Data

Dec. 3, 2014 (FR) ..... 14 61879

(51) Int. Cl.
*H01R 24/50* (2011.01)
*H01R 12/57* (2011.01)
(Continued)

(52) U.S. Cl.
CPC ..... *H01R 24/50* (2013.01); *H01R 4/02* (2013.01); *H01R 12/57* (2013.01); *H01R 12/72* (2013.01);
(Continued)

(58) Field of Classification Search
None
See application file for complete search history.

(56) References Cited

U.S. PATENT DOCUMENTS 3,783,321 A * 1/1974 Patterson ..... H01P 1/125 174/663
4,451,103 A 5/1984 Buresh
(Continued)

*Primary Examiner* — Truc T Nguyen
(74) *Attorney, Agent, or Firm* — Muncy, Geissler, Olds & Lowe, P.C.

(57) ABSTRACT

Coaxial connector for electronic card having at least one principal face and a side substantially perpendicular to the principal face, the connector comprising a base fixed to a front panel of an electromagnetic shielding housing and a pin passing through a first opening of the front panel in such a way that the pin has a free end portion which extends by projecting into the housing flush with a plane of a second opening delimited by a lower edge of a strap of the housing, the lower edge of the strap bearing against the principal face of the electronic card while the front panel bears against the side of the electronic card, the housing comprising two internal rims extending along the front panel on either side of the free end portion of the pin so as to bear on said principal face of the electronic card.

11 Claims, 3 Drawing Sheets

(51) Int. Cl.
*H01R 12/72* (2011.01)
*H01R 13/6594* (2011.01)
*H01R 4/02* (2006.01)
*H01R 103/00* (2006.01)

(52) U.S. Cl.
CPC ..... *H01R 13/6594* (2013.01); *H01R 2103/00* (2013.01)

(56) References Cited

U.S. PATENT DOCUMENTS 4,943,244 A * 7/1990 Teck ..... H01R 23/7073 439/567
5,897,384 A * 4/1999 Hosler, Sr. ..... H01R 24/50 439/581
6,030,231 A * 2/2000 Sarkiniemi ..... H01R 24/50 439/101
6,231,356 B1 * 5/2001 Stutts ..... H01R 13/6485 439/607.28
6,292,373 B1 * 9/2001 Li ..... G11B 33/1493 174/371
6,457,979 B1 * 10/2002 Dove ..... H01R 9/0515 439/63
6,824,392 B1 * 11/2004 Guo ..... H01R 24/52 439/63
6,988,912 B2 * 1/2006 Bourgeas ..... H01R 13/6599 439/581
7,210,946 B2 * 5/2007 Chen ..... G06F 1/182 361/818
7,500,855 B2 * 3/2009 Kari ..... H01R 24/50 439/63
7,527,501 B2 * 5/2009 Kuroda ..... H01P 5/085 439/581
7,946,854 B2 * 5/2011 Weidner ..... H01R 13/65802 439/581
8,152,534 B1 * 4/2012 Li ..... H01R 9/0515 439/63
8,371,864 B2 * 2/2013 Kang ..... H01R 12/721 439/108
2004/0121625 A1 * 6/2004 Togashi ..... H01R 24/50 439/63
2014/0160709 A1 * 6/2014 Imai ..... H05K 3/308 361/773

* cited by examiner

COAXIAL CONNECTOR INTEGRATED WITH A SHIELDING AND ELECTRONIC CARD EQUIPPED WITH SUCH A CONNECTOR

BACKGROUND OF THE INVENTION

Field of the Invention

The present invention relates to providing protection against electromagnetic disturbances, more particularly in the vicinity of a coaxial connector of an electronic card.

Brief Discussion of the Related Art

An electronic card generally comprises a printed circuit board defined by two main faces and four sides. On at least one of the main faces there extend conductive tracks having electronic components connected thereto with contacts that are usually soldered to ends of the conductive tracks.

In certain applications, the electronic card includes a coaxial connector connected to at least one of the electronic components of the card via conductive tracks. Such a connector comprises a base that is fastened on the electronic card and that is provided with a connection portion for connection to one end of a coaxial cable, and a pin having a free end portion that projects from the base away from the connection portion and that is soldered to a conductive track.

In order to limit the production of interference or electromagnetic disturbances, it is known to place the base on a shielding box surrounding the free end portion of the pin. The shielding box has a bottom edge presenting tabs that are received in corresponding openings in the printed circuit board. Fastening in that way is not very practical, in particular when components are put into place by means of a robot, and it leads to degraded shielding performance because of the large number of openings.

Connectors are also known in which the base has two pairs of arms, one on each side of the pin. The arms of each of the two pairs of arms are parallel to the pin, and between them they define a slot in which one side of the printed circuit board is engaged. The need for assembly and positioning clearances makes it necessary to leave gaps between the base and the printed circuit board in the vicinity of the free end portion of the pin. That gap leaves a passage for electromagnetic radiation, thus preventing effective shielding against electromagnetic disturbances.

SUMMARY OF THE INVENTION

An object of the invention is to provide means making it possible to obviate those drawbacks, at least in part.

To this end, the invention provides coaxial connector for an electronic card having at least one main face and a side substantially perpendicular to the main face. The connector comprises a base fastened to a front panel of an electromagnetic shielding box and a pin passing through a first opening in the front panel so that the pin has a free end portion that projects into the box flush with a plane of a second opening defined by the bottom edge of a belt of the box. The box is arranged so that the bottom edge of the belt can bear against the main face of the electronic card while the front panel bears against the side of the electronic card. The box further has two internal rims extending along the front panel on either side of the free end portion of the pin so as to bear against said main face of the electronic card.

Thus, the connector is integrated in the shielding box and has internal rims that can be very close to the pin so as to counter any leakage of electromagnetic radiation between the front panel and the electronic card in the vicinity of the free end portion of the pin.

Other characteristics and advantages of the invention appear on reading the following description of particular, non-limiting embodiments of the invention.

BRIEF DESCRIPTION OF THE DRAWINGS

Reference is made to the accompanying drawings, in which.

DETAILED DESCRIPTION OF THE PREFERRED EMBODIMENTS

Figure 1:
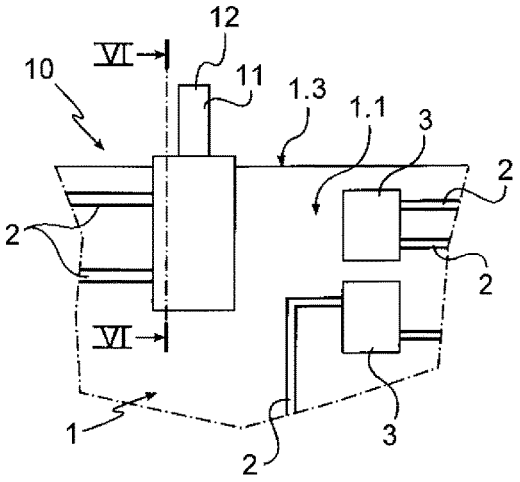
FIG. 1 is a fragmentary diagrammatic view from above of an electronic card in accordance with the invention.
Figure 2:
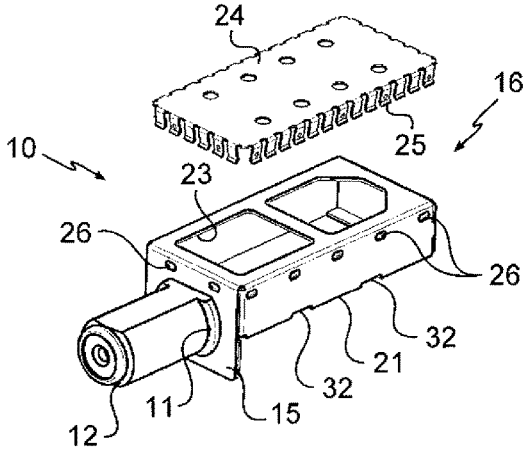
FIG. 2 is a perspective view of a connector in a first embodiment of the invention, this view showing more particularly the top of the connector.
Figure 3:
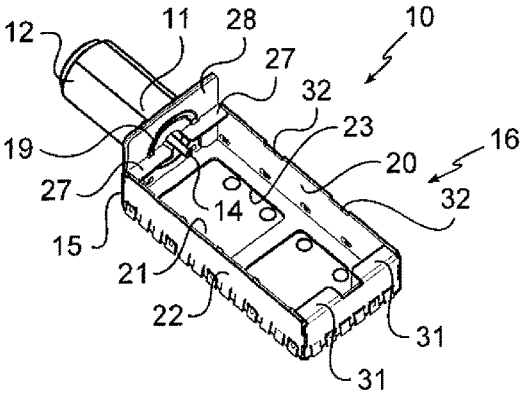
FIG. 3 is a perspective view of the same connector, this view showing more particularly the bottom of the connector.
Figure 4:
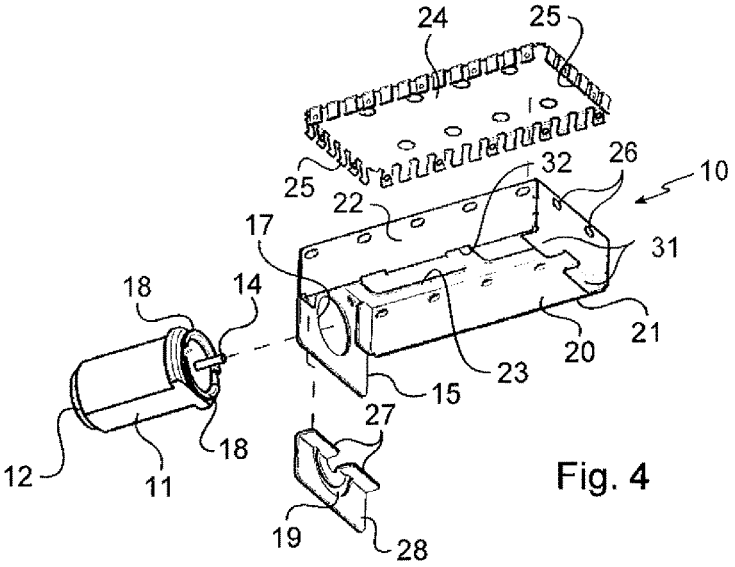
FIG. 4 is an exploded perspective view of this connector.
Figure 5:
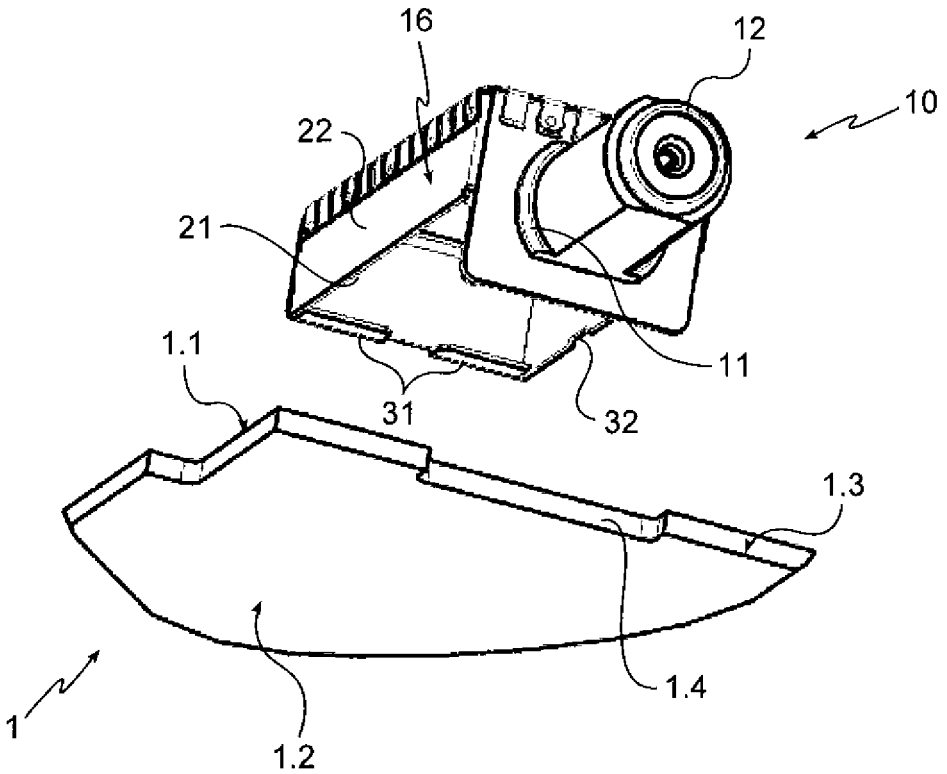
FIG. 5 is a perspective view showing the connector separate from the electronic card.
Figure 6:
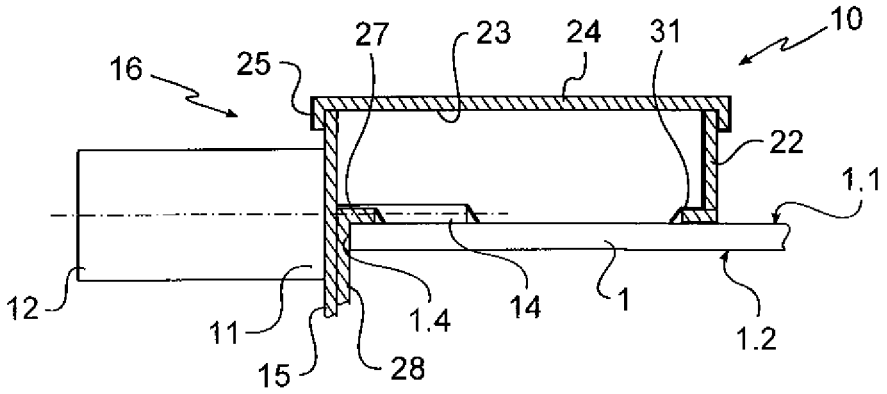
FIG. 6 is a fragmentary view of the card of the invention in section on line VI-VI of FIG. 1.

With reference to the figures, the electronic card of the invention comprises a printed circuit board given overall reference 1 that is defined by two main faces 1.1 and 1.2, and by four sides, only one of which, given reference 1.3, can be seen in the figures. On at least one of the main faces 1.1 and 1.2, an in this example on the main face 1.1, there extend conductive tracks 2 that have electronic components 3 connected thereto via contacts that are generally soldered to the ends of the electrically conductive tracks 2. In this example, the electronic card is fabricated using surface-mounted component (SMC) techniques.

The electronic card includes a connector given overall reference 10. The connector 10 is a coaxial connector of the kind for conveying TV signals. In known manner, the connector 10 comprises a base 11 having a connection portion 12 for connection to one end of a coaxial cable (not shown), and a pin having a free end portion 14 that projects from the base 11 away from the connection portion 12.

The base 11 is fastened to a front panel 15 of an electromagnetic shielding box, given overall reference 16, so that the pin passes through a first opening 17 in the front panel 15 so that its free end portion 14 projects into the box 16. The base 11 has two circularly arcuate rims 18, namely a bottom rim and a top rim that are coaxial around the pin 14, which rims are engaged in the first opening 17 of the front panel 15 and are crimped to the front panel 15.

The free end portion 14 has a bottom generator line flush with a plane of a second opening 20 defined by a bottom edge 21 of a belt 22 of the box 16. The belt 22 and the front panel 15 in this example have an outline that is rectangular.

The box 16 is provided with a third opening 23 formed in a top portion of the box 16 opposite from the second opening 20, and it is provided with a lid 24 to releasably close the third opening 23. The lid 24 covers the top portion of the box 16 and has an outline provided with spring tabs 25, some of which are engaged in setbacks 26, in this example in holes, formed in the top portion of the belt 22 of the box 16.

The box 16 is arranged so that the bottom edge 21 of the belt 22 can press against the main face 1.1 of the printed circuit board 1 of the electronic card, while the front panel 15 presses against the side 1.3 of the printed circuit board. The side 1.3 includes a cutout 1.4 receiving the front panel 15.

The bottom edge 21 of the belt 22 is provided, opposite from the front panel 15, with at least one bearing rim 31 (there being two in this example) for bearing against the main face 1.1 of the electronic card.

The box 16 has two internal rims 27 extending along the front panel 15 on either side of the free end portion 14 of the pin so as to bear against said main face 1.1 of the printed circuit board of the electronic card. The internal rims 27 have respective bottom surfaces in the plane defined by the bottom edge 21 of the belt 22 so as to rest flat on the main face 1.1 of the printed circuit board 1 of the electronic card.

With reference more particularly to FIGS. 1 to 6, and in the first embodiment, the internal rims 27 are on a separate piece fitted to the front panel 15. More precisely, the internal rims 27 belong to a plate 28 pressed against the projecting surface of the front panel 15 from which the free end portion 14 of the pin extends. The plate 28 is provided with a circularly arcuate groove 19 receiving the bottom rim 18 of the base 11 so that crimping the bottom rim 18 serves to fasten both the base 11 and the plate 28 to the front panel 15.

Figure 7:
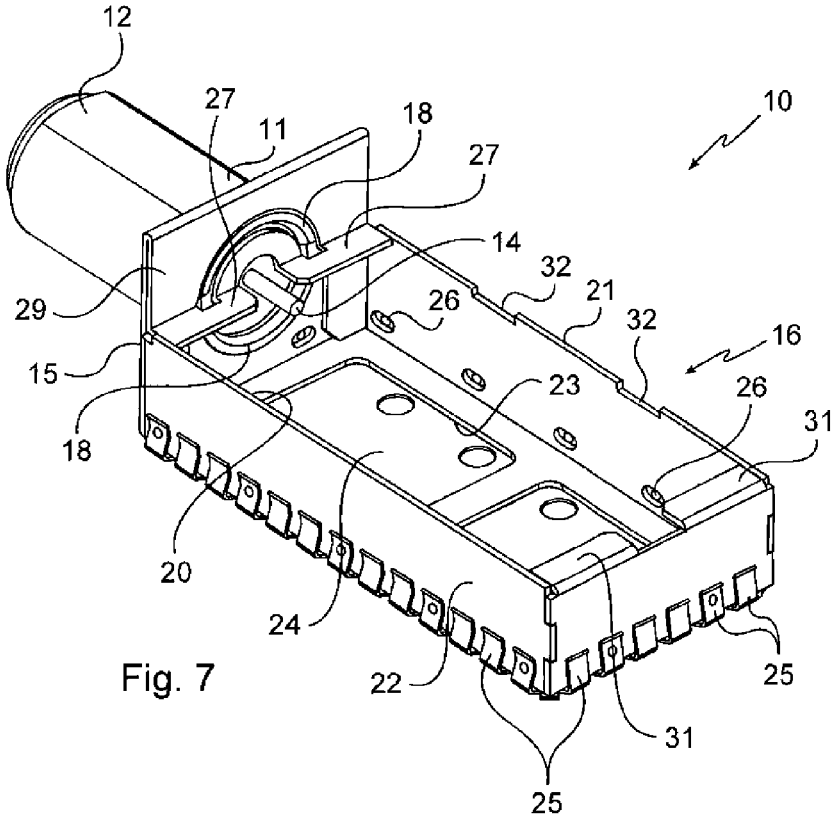
FIG. 7 is a diagrammatic perspective view of a connector in a second embodiment of the invention, this view showing more particularly the bottom of the connector.

With reference to FIG. 7, and in a second embodiment, the internal rims 27 form portions of the front panel 15. More precisely, the front panel 15 includes a portion 29 that is folded over against the front panel 15 on its side opposite from the base 11, and the internal rims 27 belong to the folded-over portion 29.

Figure 8:
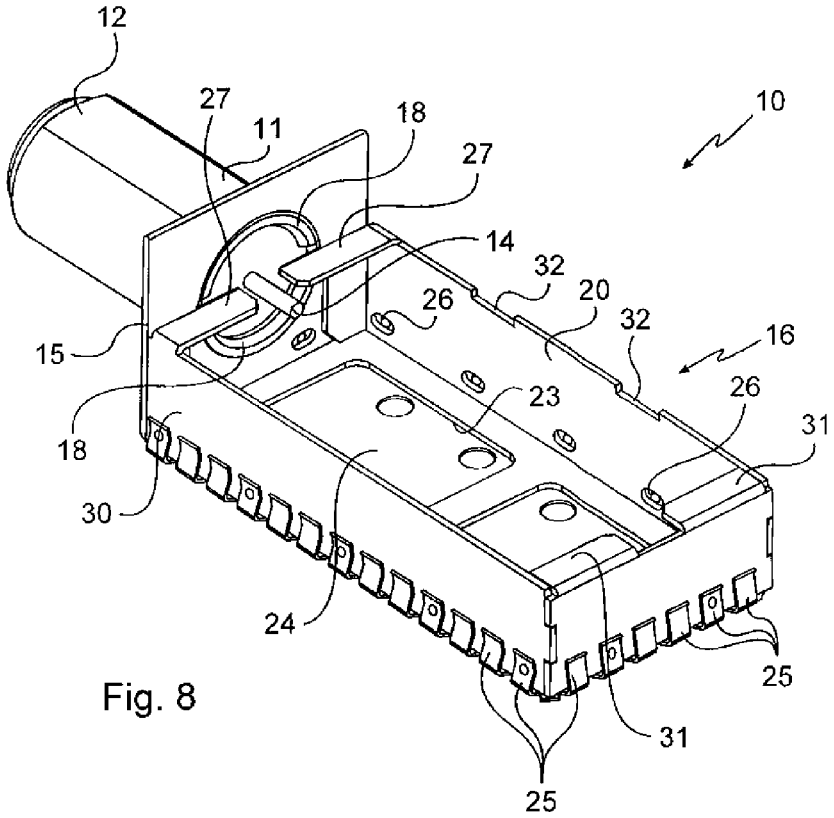
FIG. 8 is a diagrammatic perspective view of a connector in a third embodiment of the invention, this view showing more particularly the bottom of the connector.

With reference to FIG. 8, and in the third embodiment, the internal rims 27 project from two side walls 30 forming portions of the belt 22 and extending from opposite sides of the front panel 15.

In general manner, the connector is preferably mounted by means of a robot on the printed circuit board 1 while it is held horizontal. While the connector is being put into place, the box 16 is not covered by the lid 24. This makes it easier for the connector to be positioned optically by viewing the free end portion of the pin through the third opening 23. Since the connector 10 in this example has a center of gravity inside the box 16 (the box 16 weighs more than the base 11, in particular because of the bearing rim 31), the connector remains in position on the printed circuit board 1 before the soldering operation without there being any need to hold it there. The soldering operation is performed by passing through an oven for melting solder paste previously arranged on the printed circuit board. At the end of this operation, the free end portion 14 of the pin needs to be soldered to a corresponding tab of the printed circuit board (the electrically conductive tab extending on the main face of the printed circuit board close to the side 1.3) and the box 16 needs to be soldered along the entire length of the belt 22 (with the exception of notches for passing tracks) and to the internal rims 27. It is possible to verify the quality of the soldering optically, in particular through the third opening 23. After this verification, the lid 24 is put into place on the box 16. Having a lid that is separate is also advantageous in that it makes it possible to limit the maximum weight for transporting while mounting the connector. The removable nature of the lid 24 also makes it possible to facilitate subsequent maintenance operations.

It should be observed that the bottom edge 21 of the belt 22 of the box 16 includes notches 32 for passing some of the conductive tracks 2.

Naturally, the invention is not limited to the embodiments described but covers any variant coming within the ambit of the invention as defined by the claims.

In particular, the connector may have a structure that is different from that described. Specifically, the box 16 need not have a removable lid. The box 16 need not have a third opening. To make subsequent maintenance operations possible, the top portion of the box may then comprise a wall that is connected to the belt via a line of weakness forming a break starter (for example, this line may be formed by an in-line series of cuts enabling said wall to be torn off).

In addition, the base 11 may be fastened to the front panel by any means, and in particular by welding.

The invention claimed is:

1. A coaxial connector for an electronic card having at least one main face and a side substantially perpendicular to the main face, the coaxial connector comprising a base fastened to a front panel of an electromagnetic shielding box and a pin passing through a first opening in the front panel so that the pin has a free end portion that projects into the box, the free end portion being flush with a plane of a second opening defined by a bottom edge of a belt of the box, the box being arranged so that the bottom edge of the belt can bear against the main face of the electronic card while the front panel bears against the side of the electronic card, the box having two internal rims extending along the front panel on either side of the free end portion of the pin so that the two internal rims bear against said main face of the electronic card.

2. The connector according to claim 1, wherein the internal rims are separate pieces fitted to the front panel.

3. The connector according to claim 2, wherein the internal rims form parts of a plate fitted to the front panel.

4. A coaxial connector for an electronic card having at least one main face and a side substantially perpendicular to the main face, the coaxial connector comprising a base fastened to a front panel of an electromagnetic shielding box and a pin passing through a first opening in the front panel so that the pin has a free end portion that projects into the box, the free end portion being flush with a plane of a second opening defined by a bottom edge of a belt of the box, the box being arranged so that the bottom edge of the belt can bear against the main face of the electronic card while the front panel bears against the side of the electronic card, the box having two internal rims extending along the front panel on either side of the free end portion of the pin so that the two internal rims bear against said main face of the electronic card, wherein the internal rims form portions of the front panel and the front panel includes a folded-over portion and the internal rims form portions of the folded-over portion.

5. The connector according to claim 1, wherein the internal rims project from two side walls forming portions of the belt and extending from opposite sides of the front panel.

6. The electronic card comprising a printed circuit board having at least one main face and a side substantially perpendicular to the main face, an electrically conductive tab extending over the main face in the vicinity of the side, and a connector according to claim 1, the bottom edge of the belt of the box bearing against the main face of the electronic card, while the front panel bears against the side of the electronic card, and the free end portion of the pin being soldered to the electrically conductive tab, the electronic card having at least one electrically conductive track extending over the main face, the bottom edge of the belt of the box including at least one notch for passing the conductive track.

7. A coaxial connector for an electronic card having at least one main face and a side substantially perpendicular to the main face, the coaxial connector comprising a base fastened to a front panel of an electromagnetic shielding box and a pin passing through a first opening in the front panel so that the pin has a free end portion that projects into the box, the free end portion being flush with a plane of a second opening defined by a bottom edge of a belt of the box, the box being arranged so that the bottom edge of the belt can bear against the main face of the electronic card while the front panel bears against the side of the electronic card, the box having two internal rims extending along the front panel on either side of the free end portion of the pin so that the two internal rims bear against said main face of the electronic card, wherein the box is provided with a third opening formed in a top portion of the box opposite from the second opening, and is provided with a removable lid for closing the third opening.

8. The connector according to claim 7, wherein the lid covers the top portion of the box, and has spring tabs engaged in setbacks formed in the top portion of the box.

9. A coaxial connector for an electronic card having at least one main face and a side substantially perpendicular to the main face, the coaxial connector comprising a base fastened to a front panel of an electromagnetic shielding box and a pin passing through a first opening in the front panel so that the pin has a free end portion that projects into the box the free end portion being flush with a plane of a second opening defined by a bottom edge of a belt of the box, the box being arranged so that the bottom edge of the belt can bear against the main face of the electronic card while the front panel bears against the side of the electronic card, the box having two internal rims extending along the front panel on either side of the free end portion of the pin so that the two internal rims bear against said main face of the electronic card, wherein the base includes a circularly arcuate rim that is engaged in a circularly arcuate groove in the front panel and that is crimped to the front panel.

10. A coaxial connector for an electronic card having at least one main face and a side substantially perpendicular to the main face, the coaxial connector comprising a base fastened to a front panel of an electromagnetic shielding box and a pin passing through a first opening in the front panel so that the pin has a free end portion that projects into the box, the free end portion being flush with a plane of a second opening defined by a bottom edge of a belt of the box, the box being arranged so that the bottom edge of the belt can bear against the main face of the electronic card while the front panel bears against the side of the electronic card, the box having two internal rims extending along the front panel on either side of the free end portion of the pin so that the two internal rims bear against said main face of the electronic card, wherein the box weighs more than the base and the bottom edge of the belt is provided opposite from the front panel, with a bearing rim for bearing against the main face of the electronic card.

11. A coaxial connector for an electronic card having at least one main face and a side substantially perpendicular to the main face, the coaxial connector comprising a base fastened to a front panel of an electromagnetic shielding box and a pin passing through a first opening in the front panel so that the pin has a free end portion that projects into the box, the free end portion being flush with a plane of a second opening defined by a bottom edge of a belt of the box, the box being arranged so that the bottom edge of the belt can bear against the main face of the electronic card while the front panel bears against the side of the electronic card, the box having two internal rims extending along the front panel on either side of the free end portion of the pin so that the two internal rims bear against said main face of the electronic card, wherein the internal rims belong to a separate piece fitted to the front panel, the separate piece being a plate pressed against a projecting surface of the front panel from which the free end portion of the pin extends, the internal rims extending from the plate.

* * * * *